US005327662A

United States Patent [19]

Hallenbeck

[11] Patent Number: 5,327,662

[45] Date of Patent: Jul. 12, 1994

[54] SHOE, ESPECIALLY AN ATHLETIC, LEISURE OR REHABILITATION SHOE HAVING A CENTRAL CLOSURE

[75] Inventor: Barry Hallenbeck, Nashua, N.H.

[73] Assignee: Tretorn AB, Helsingborg, Sweden

[21] Appl. No.: 63,709

[22] Filed: May 21, 1993

[30] Foreign Application Priority Data

Jul. 13, 1992 [DE] Fed. Rep. of Germany ..... 9209383

[51] Int. Cl.[5] ..... A43B 11/00

[52] U.S. Cl. ..... 36/50.1; 36/54

[58] Field of Search ..... 36/50.1, 50.5, 51, 54; 24/712.1, 712.5, 712.9, 713, 71.2, 685 K

[56] References Cited

U.S. PATENT DOCUMENTS

| | | | |
|---|---|---|---|
| 716,528 | 12/1902 | Flowers | 36/54 |
| 2,345,057 | 3/1944 | Marinetti | 36/50.1 |
| 2,994,935 | 8/1961 | Buchholz . | |
| 3,169,325 | 2/1965 | Fesl | 36/50.5 |
| 4,551,932 | 11/1985 | Schoch . | |
| 4,726,126 | 2/1988 | Bernhard . | |
| 4,727,660 | 3/1988 | Bernhard . | |
| 4,748,751 | 6/1988 | Sartor | 36/50.5 |
| 5,117,567 | 6/1992 | Berger | 36/50.1 |
| 5,177,882 | 1/1993 | Berger | 36/50.1 |

FOREIGN PATENT DOCUMENTS

| | | | |
|---|---|---|---|
| 3345661 | 6/1984 | Fed. Rep. of Germany | 36/50.1 |
| 2501977 | 9/1982 | France . | |

*Primary Examiner*—Steven N. Meyers
*Assistant Examiner*—Marie Denise Patterson

[57] ABSTRACT

A shoe, especially an athletic, leisure or rehabilitation shoe, with an upper part consisting, at least partially, of a flexible material which covers the ankle of the foot (¾ mid-height) or rises above the ankle (high top) and which is provided with an instep cover coveting the instep of the foot (which is movable like a tongue or forms the tongue or a part of it) on which a central rotary closure is provided, with which at least the instep length of at least one tightening element can be shortened for closing the shoe and can be extended for opening it, and the tightening element is alternately guided respectively from a guide element on the upper side part to a guide element of the instep cover. To achieve a quick closure of such a shoe with a central rotary closure, while maintaining its usual size for low top shoes, also in shoes to be opened wide and in those with a high top upper, for example, in basketball or volleyball shoes, in addition to a central rotary closure, a sliding closure is provided that can be engaged or disengaged at least in the closed position, and which is also coupled with the tightening element and which makes possible a tightening in one sliding direction and a relaxing of the tightening element or elements in the other sliding direction.

20 Claims, 1 Drawing Sheet

SHOE, ESPECIALLY AN ATHLETIC, LEISURE OR REHABILITATION SHOE HAVING A CENTRAL CLOSURE

BACKGROUND OF THE INVENTION

This invention relates to a shoe, especially an athletic, leisure or rehabilitation shoe, with an upper part consisting, at least partially, of a flexible material which covers the ankle of the foot (¾ mid-height) or rises above the ankle (high top). More specifically, the invention relates to a shoe of this type which is provided with an instep cover covering the instep of the foot (which is movable like a tongue or forms the tongue or a part of it) on which a central rotary closure is provided, with which at least the instep length of a tightening element can be shortened for closing the shoe and can be extended for opening it, and the tightening element is alternately guided respectively from a guide element on the upper side part to a guide element of the instep cover.

Such a sport shoe is known, for example, from commonly owned, co-pending U.S. patent application No. 08/010,385, and low top versions of such shoes are disclosed in U.S. Pat. Nos. 5,177,882 and 5,117,567. In using the known central closure of the noted patents for shoes which have a very large open throat area or in shoes with a high top upper, which by nature have a greater throat area, the central rotary closure has to be able to accommodate a large lengthwise section of the tightening element in the closed position. Therefore, it has to have a correspondingly large winding space for the tightening element. Otherwise, to obtain an effective closure, as disclosed in the noted co-pending patent application, a more complex double-reel central closure must be used with multiple tightening elements.

Sliding closures for shoes are also known; for example, a sliding closure is known from U.S. Pat. No. 2,994,935 which extends over the entire length of the tongue. It consists of a relatively rigid material. A good matching of the shoe in this sliding area to the shape of the foot is, therefore, not possible. A shortening of the sliding path of the sliding closure is not possible because of the necessary opening angle of the upper side parts and the, thus, necessary large instep length of the tightening element. Therefore, such sliding closures could not catch on in the market.

Similarly, zipper-type closures are known, for example, from U.S. Pat. No. 2,345,057 and French Utility Model Publication 2501977. These closures, which are attached to the shoe upper by conventional shoe laces, also, extend over the entire length of the tongue.

SUMMARY OF THE INVENTION

In view of the foregoing, it is a primary object of the present invention to achieve a quick closure of a shoe with a central rotary closure, while maintaining its usual size for low top shoes, also in shoes to be opened wide and in those with a high top upper, for example, in basketball or volleyball shoes.

This object is achieved by the features in that, in addition to a central rotary closure, a sliding closure is provided that can be engaged or disengaged at least in the closed position, and which is also coupled with the tightening element or at least with one of several tightening elements and which makes possible a tightening in one sliding direction and a relaxing of the tightening element or elements in the other sliding direction.

By the additional use of a sliding closure, on the one hand, a central rotary closure with a smaller winding space than would otherwise be necessary can be used. On the other hand, the sliding path of the sliding closure can also be kept relatively small because of the existing central rotary closure, so that it does not disadvantageously influence the mobility or desired flexibility of the shoe or of the shoe section, on which it is present.

With the object of the invention, in contrast to prior art sliding and zipper closures, only a short sliding length is necessary and the sliding closure is placed in an area in which no significant matching to the shape of the foot is necessary.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
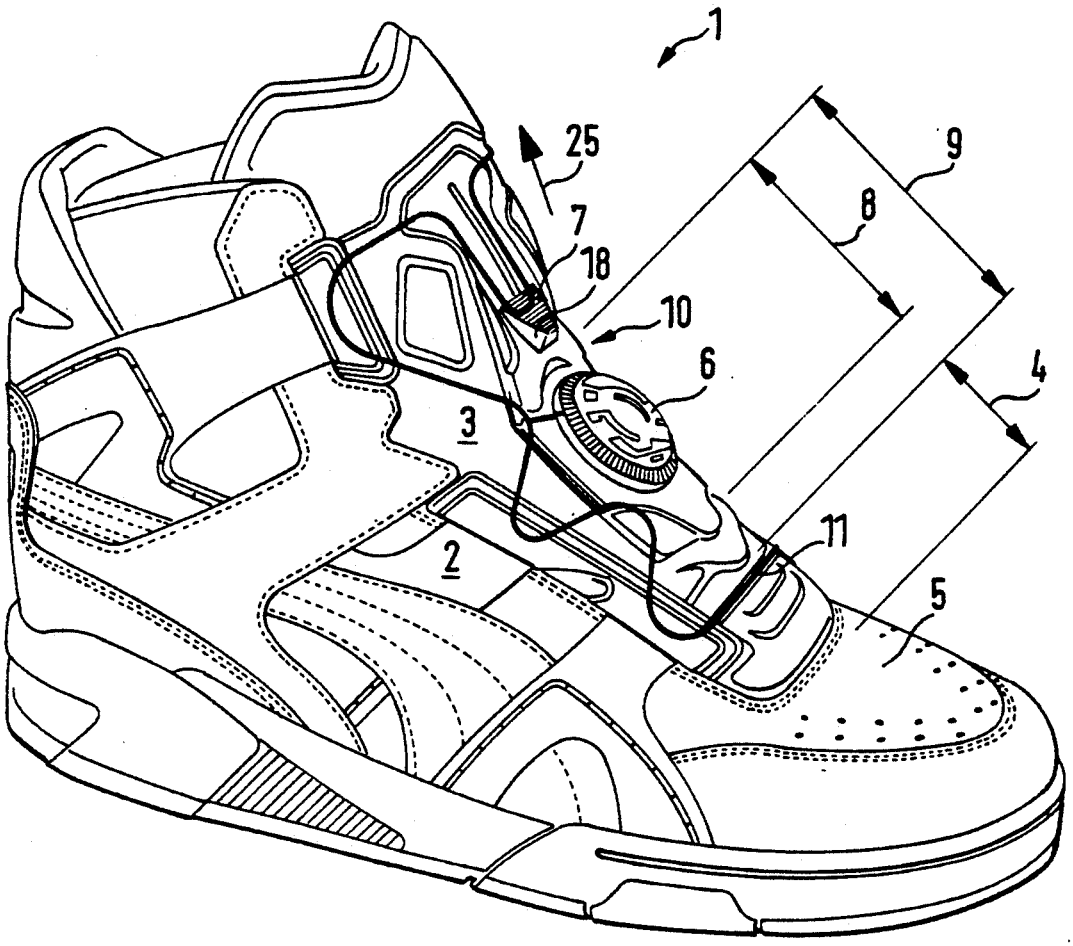
FIG. 1 is a perspective view of an athletic shoe with an upper preferably extending up to the initial area of the calf.

In FIG. 1, a shoe 1 has an upper with side parts 2, of which only one is visible, and an instep cover 3, which may be a separate cover element that is movable like a tongue or which may be formed by the tongue or a part of it or attached to it; as such, all future references to the term "instep cover" should be construed in this context as encompassing any of these possibilities. Instep cover 3 is connected with the material 5 of the upper shoe 1 in the metatarsophalangeal joint area 4.

Instep cover 3 is provided with a central rotary closure 6 and with a sliding closure 7. Central rotary closure 6 is preferably present in a middle to upper section 8 of an area 9 between metatarsophalangeal joint area 4 and ankle joint 10. Sliding closure 7 is located above central closure 6, i.e., in the area of ankle joint 10 or above it.

A tightening element 11, for example, a wire or cable made of plastic or metal, is permanently connected with central rotary closure 6 and can be wound or unwound within the central rotary closure 6. Tightening element 11 runs, from central rotary closure 6, both upwardly and downwardly at each side of the upper, and in each case braces an upper side part 2 with respect to the respectively adjoining side area of instep cover 3.

Figure 2:
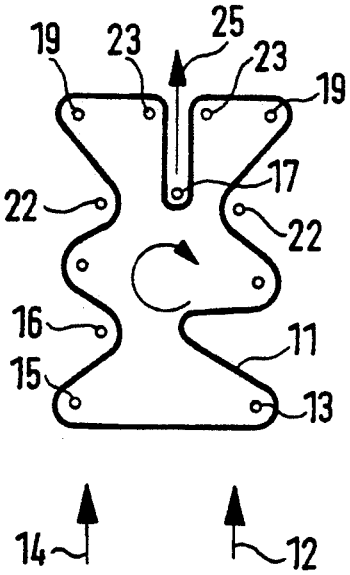
FIG. 2 is a diagrammatic representation of the tightening principle used in the shoe of FIG. 1.

In the embodiment represented in FIG. 1, tightening element 11 rum from central rotary closure 6, according to FIG. 2, for example, on one side 12 to a guide element 13 of side part 2, across the instep cover 3 or the vamp to a guide element 15 on side 14 of the opposite side part 2, and from there, to a guide element 16 on instep cover 3. From here, the tightening element 11 runs, alternately by other guide elements, then over a permanent coupling or guide element 17, for example, a roll, of slider 18 of sliding closure 7, back to side 12 where it runs, via further guide elements, back to central rotary closure 6. The attachment of tightening element 11 can also be provided at other points, for example, on upper material 5, on instep cover 3, on sliding closure 7 or the like and can be coupled in a suitable way with central rotary closure 6 and slider 18.

Sliding closure 7 is designed so that slider 18 can be engaged and disengaged, at least in the sliding position. It is advantageously placed so that the sliding direction runs in the direction of the lengthwise axis of instep cover 3. The tightening of tightening element 11 takes place, preferably, by sliding of slider 18 toward the shoe tip or central rotary closure 6.

Figure 3:
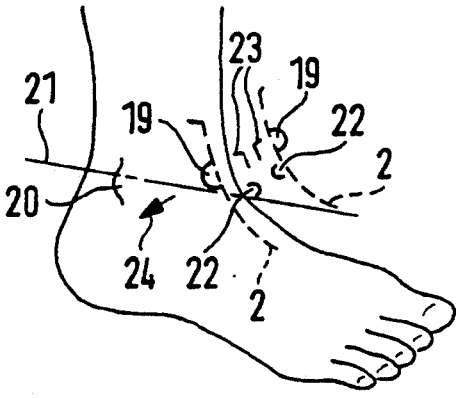
FIG. 3 is a diagrammatic representation of a possible arrangement of the guide elements in the ankle joint area.

To assure a good fit of the foot in shoe 1, a guide element 19 is provided on both side parts 2 in the area of ankle joint 10 or above ankle 20 or above a line 21 drawn in FIG. 3 running horizontally through ankle 20. A guide element 22 on instep cover 3 is associated with each of the guide elements 19, being placed below it, i.e., in or under the ankle joint area, and a second guide element 23 can be provided in association with each guide elements 19 on instep cover 3, at or above it. In the illustrated embodiment, the guide elements 23 are attached at approximately the same height as guide elements 19. From guide elements 23, tightening element 11 is deflected to slider 18, i.e., here by about 90°, and on slider 18, itself, or on another guide element provided there, it is, again, deflected, this time by almost 180°. The tightening element can also be attached on slider 18 instead of being guided over it.

By this arrangement of guide elements 19 on upper side parts 2, a tightening in the direction of arrow 24 (FIG. 3) to the heel or to the Achilles tendon can be produced, so that a good holding of the heel in the shoe is assured.

For quick opening of the closure system according to the invention in an athletic shoe with a high top upper, such as, for example, in a basketball or volleyball shoe, central rotary closure 6 and/or also sliding closure 7 can be provided with a quick disengaging device known in the art.

In FIG. 1 or in the diagrammatic representation of FIG. 2, slider 18 is present in each case in the closed position. The direction in which sliding closure 7 can be opened is indicated in FIGS. 1 and 2 with arrow 25.

Instead of a sliding closure, any other element which makes possible the opening and closing of this additional closure in a generally "switch-like" manner can be used. The guides over which the tensioning element passes may be of the type shown and described in the above-noted U.S. Pat. Nos. 5,177,882 and 5,117,567, and the rotary closure device may be of the type shown and described in U.S. Pat. No. 5,042,177.

If the above-described shoe with a high top upper is to be used as a rehabilitation shoe, additional support elements in the ankle area and special guiding areas in the outsole area can preferably be provided which make possible an especially good hold of the foot in the shoe and as unimpeded as possible a sliding movement of such a rehabilitation shoe on the assigned bottom surface, such being known from U.S. Pat. Nos. 4,726,126 and 4,727,660, respectively.

While only a single embodiment in accordance with the present invention has been shown and described, it is to be understood that the invention is not limited thereto, and is susceptible of numerous changes and modifications as will be known to those skilled in the art. Therefore, the invention is not to be limited to the details shown and described herein, and is instead intended to include all such changes and modifications as are encompassed by the scope of the appended claims.

I claim:

1. A shoe having an upper which is high enough to cover an ankle joint of the foot of a wearer and which is formed of a flexible material at least in side parts thereof, an instep cover covering an instep of the foot, a central rotary closure provided on the instep cover, with which at least an instep length of a tightening element can be shortened for closing the shoe and can be extended for opening it, the tightening element being alternately guided between guide elements on each of the side parts and respective guide elements of the instep cover; wherein, in addition to the central rotary closure, a sliding closure is provided that is engageable and disengageable at least when the length of the tightening element has been shortened by the rotary closure, said sliding closure being coupled with the tightening element and which produces a tightening of the tightening element in one sliding direction and a relaxing of the tightening element in an opposite sliding direction.

2. A shoe according to claim 1, wherein the central rotary closure is provided on the instep cover in a middle to upper section of an area between a metatarsophalangeal joint area and the ankle joint area; and wherein the sliding closure is located in an area at least as high as the ankle joint.

3. A shoe according to claim 2, wherein the upper extends above the ankle joint area and the area in which the sliding closure is located is above the ankle joint.

4. A shoe according to claim 2, wherein the sliding directions of the sliding closure run in a lengthwise direction of the instep cover.

5. A shoe according to claim 4, wherein the sliding direction of the sliding closure which produces tightening of tightening element is downward toward the central rotary closure.

6. A shoe according to claim 5, wherein one of the guide elements on each of the side parts is provided just above the ankle joint area and wherein a respectively associated guide element provided on the instep cover is provided in the ankle joint area in a line running through the ankle joint area, so that a tightening action is produced by the tightening element which is directed toward a heel area of the shoe.

7. A shoe according to claim 6, wherein said one of the guide elements is at approximately the same height as an associated guide element on the instep cover with which the tightening element is deflected toward a slider of the sliding closure.

8. A shoe according to claim 7, wherein an additional guide element is used for coupling the slider with the tightening element.

9. A shoe according to claim 8, wherein the tightening element rum from the central rotary closure, via the guide elements, across the upper from a first side part to an opposite side part, upward along the throat of the shoe, back to first side part via the sliding closure and from there back down along the throat to the central rotary closure.

10. A shoe according to claim 1, wherein the sliding directions of the sliding closure run in a lengthwise direction of the instep cover.

11. A shoe according to claim 10, wherein the sliding direction of the sliding closure which produces tightening of tightening element is downward toward the central rotary closure.

12. A shoe according to claim 11, wherein one of the guide elements on each of the side parts is provided just above the ankle joint area and wherein a respectively associated guide element provided on the instep cover is provided in the ankle joint area in a line running through the ankle joint area, so that a tightening action is produced by the tightening element which is directed toward a heel area of the shoe.

13. A shoe according to claim 12, wherein said one of the guide elements is at approximately the same height as an associated guide element on the instep cover with which the tightening element is deflected toward a slider of the sliding closure.

14. A shoe according to claim 13, wherein an additional guide element is used for coupling the slider with the tightening element.

15. A shoe according to claim 14, wherein the tightening element rum from the central rotary closure, via the guide elements, across the upper from a first side part to an opposite side part, upward along the throat of the shoe, back to first side part via the sliding closure and from there back down along the throat to the central rotary closure.

16. A shoe according to claim 1, wherein one of the guide elements on each of the side parts is provided just above the ankle joint area and wherein a respectively associated guide element provided on the instep cover is provided in the ankle joint area in a line running through the ankle joint area, so that a tightening action is produced by the tightening element which is directed toward a heel area of the shoe.

17. A shoe according to claim 16, wherein said one of the guide elements is at approximately the same height as an associated guide element on the instep cover with which the tightening element is deflected toward a slider of the sliding closure.

18. A shoe according to claim 1, wherein an additional guide element is used for coupling the slider with the tightening element.

19. A shoe according to claim 1, wherein the tightening element runs from the central rotary closure, via the guide elements, across the upper from a first side part to an opposite side part, upward along the throat of the shoe, back to first side part via the sliding closure and from there back down along the throat to the central rotary closure.

20. A shoe according to claim 19, wherein the sliding directions of the sliding closure run in a lengthwise direction of the instep cover and the sliding direction which produces tightening of tightening element is downward toward the central rotary closure.

* * * * *